US010989509B2

(12) United States Patent
Robertson, Jr. et al.

(10) Patent No.: US 10,989,509 B2
(45) Date of Patent: Apr. 27, 2021

(54) PRIMER ADAPTER ASSEMBLY

(71) Applicant: Combined Systems, Inc., Jamestown, PA (US)

(72) Inventors: Ralph E. Robertson, Jr., Largo, FL (US); Jason Michael Ohler, Polk, PA (US); Mathew Steven Mack, Burghill, OH (US)

(73) Assignee: COMBINED SYSTEMS, INC., Jamestown, PA (US)

( * ) Notice: Subject to any disclaimer, the term of this patent is extended or adjusted under 35 U.S.C. 154(b) by 0 days.

(21) Appl. No.: 15/725,636

(22) Filed: Oct. 5, 2017

(65) Prior Publication Data

US 2019/0107377 A1 Apr. 11, 2019

(51) Int. Cl.
*F42C 19/02* (2006.01)
*F42C 14/02* (2006.01)
(Continued)

(52) U.S. Cl.
CPC ..... *F42C 14/02* (2013.01); *F42C 19/02* (2013.01); *F42C 19/0803* (2013.01);
(Continued)

(58) Field of Classification Search
CPC .. F42B 27/00; F42B 27/08; F42B 3/16; F42C 19/02; F42C 9/08; F42C 19/083; F42C 19/0823; F42C 19/10; F42C 19/08; F42C 7/12; F42C 14/02; F42C 19/0803; F42C 19/0807; F42C 19/0846; C06C 7/00
(Continued)

(56) References Cited

U.S. PATENT DOCUMENTS 733,638 A * 7/1903 Gardner ..... F42C 19/10 102/204
2,562,928 A * 8/1951 Lewis ..... F42C 14/02 102/261

(Continued)

FOREIGN PATENT DOCUMENTS

DE 3126303 A1 * 1/1983 ..... F42C 19/10

OTHER PUBLICATIONS

EPO Machine translation of DE 3126303 A1; Beermann, Paul (Year: 1983).*

*Primary Examiner* — James S Bergin
(74) *Attorney, Agent, or Firm* — Bennet K. Langlotz; Langlotz Patent & Trademark Works, LLC

(57) ABSTRACT

Primer adapter assemblies have a body having a cylindrical exterior sidewall adapted to be closely received in a chamber having a chamber diameter, the body defining a central passage including a cylindrical aft portion adapted to closely receive a primer having a primer diameter greater than or equal to the chamber diameter, the body having an aft surface, and a malleable skirt extending aft of the aft surface and defining an installation aperture, the malleable skirt being operable to deform inward to form an opening having a diameter less than the primer diameter, such that a primer in the cylindrical aft portion of the central passage is retained. The skirt may have a tapered cross-section. The skirt may encircle the central passage. The skirt may be concentric with the central passage. The body may include a flange defining the aft surface and having a diameter greater than the chamber diameter.

19 Claims, 5 Drawing Sheets

(51) Int. Cl.

| | |
|---|---|
| ***F42C 19/10*** | (2006.01) |
| ***F42C 19/08*** | (2006.01) |
| *F42B 27/00* | (2006.01) |
| *F42C 15/31* | (2006.01) |

(52) U.S. Cl.
CPC ..... *F42C 19/0807* (2013.01); *F42C 19/0846* (2013.01); *F42C 19/10* (2013.01); *F42B 27/00* (2013.01); *F42C 15/31* (2013.01)

(58) Field of Classification Search
USPC ..... 102/204, 482, 486, 487, 488
See application file for complete search history.

(56) References Cited

U.S. PATENT DOCUMENTS

| | | | | | |
|---|---|---|---|---|---|
| 3,705,552 | A * | 12/1972 | Lerman | F42C 9/10 | 102/487 |
| 4,459,914 | A * | 7/1984 | Caruso | F42B 3/16 | 102/204 |
| 4,771,693 | A * | 9/1988 | Prasnik | F42B 3/16 | 102/204 |
| 4,926,752 | A * | 5/1990 | DiRubbio | F42C 14/02 | 102/202.13 |
| 5,003,879 | A * | 4/1991 | Jones | F42B 3/16 | 102/202.13 |
| 5,799,977 | A * | 9/1998 | Miyazaki | B60R 22/4633 | 102/204 |
| 6,578,489 | B2 * | 6/2003 | Boyer | F42C 15/31 | 102/272 |
| 6,971,314 | B2 * | 12/2005 | Maguire | F42B 3/00 | 102/401 |
| 8,453,573 | B1 | 6/2013 | McKimm et al. | | |

* cited by examiner

PRIMER ADAPTER ASSEMBLY

FIELD OF THE INVENTION

The present invention relates to pyrotechnic fuzes and grenades, and more particularly to an assembly that enables the use of a more cost effective and reliable primer in the grenade fuze.

BACKGROUND OF THE INVENTION

Several grenades utilized by the US military include the M201A1 igniting fuze. The M201A1 igniting fuze was designed to use an M39A1 primer. However, supply of the M39A1 primer has been found to be unreliable. Furthermore, the M42 primer, which is used with M228 and M213 fuzes, is more reliable and less expensive. Unfortunately, the M42 primer is smaller than the M39A1 primer, so the M42 primer cannot be directly substituted for the M39A1 primer. Instead, an adapter must be used to ensure the M42 primer is securely retained within the delay cartridge, which is then inserted into the chamber of the M201A1 fuze.

U.S. Pat. No. 8,453,573 to McKimm et al. discloses a primer adapter for hand grenade fuze that attempts to address the need to use the M42 primer in the M201A1 fuze. Although McKimm et al.'s adapter does fit the M42 primer securely within the delay cartridge of the M201A1 fuze, testing has established the adapter does not adequately retain the primer within the adapter when the M201A1 fuze functions. This failure results in the primer blowing out of the adapter and failing to ignite the grenade.

Therefore, a need exists for a new and improved primer adapter assembly that retains the primer within the adapter during fuze function to ensure grenade ignition. In this regard, the various embodiments of the present invention substantially fulfill at least some of these needs. In this respect, the primer adapter assembly according to the present invention substantially departs from the conventional concepts and designs of the prior art, and in doing so provides an apparatus primarily developed for the purpose of providing a primer adapter assembly that retains the primer within the adapter during fuze function to ensure grenade ignition.

SUMMARY OF THE INVENTION

The present invention provides an improved primer adapter assembly, and overcomes the above-mentioned disadvantages and drawbacks of the prior art. As such, the general purpose of the present invention, which will be described subsequently in greater detail, is to provide an improved primer adapter assembly that has all the advantages of the prior art mentioned above.

To attain this, the preferred embodiment of the present invention essentially comprises a body having a cylindrical exterior sidewall adapted to be closely received in a chamber having a chamber diameter, the body defining a central passage including a cylindrical aft portion adapted to closely receive a primer having a primer diameter greater than or equal to the chamber diameter, the body having an aft surface, and a malleable skirt extending aft of the aft surface and defining an installation aperture, the malleable skirt being operable to deform inward to form an opening having a diameter less than the primer diameter, such that a primer in the cylindrical aft portion of the central passage is retained. The skirt may have a tapered cross-section. The skirt may encircle the central passage. The skirt may be concentric with the central passage. The body may include a flange defining the aft surface and having a diameter greater than the chamber diameter such that insertion of the primer adapter into the chamber is limited. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
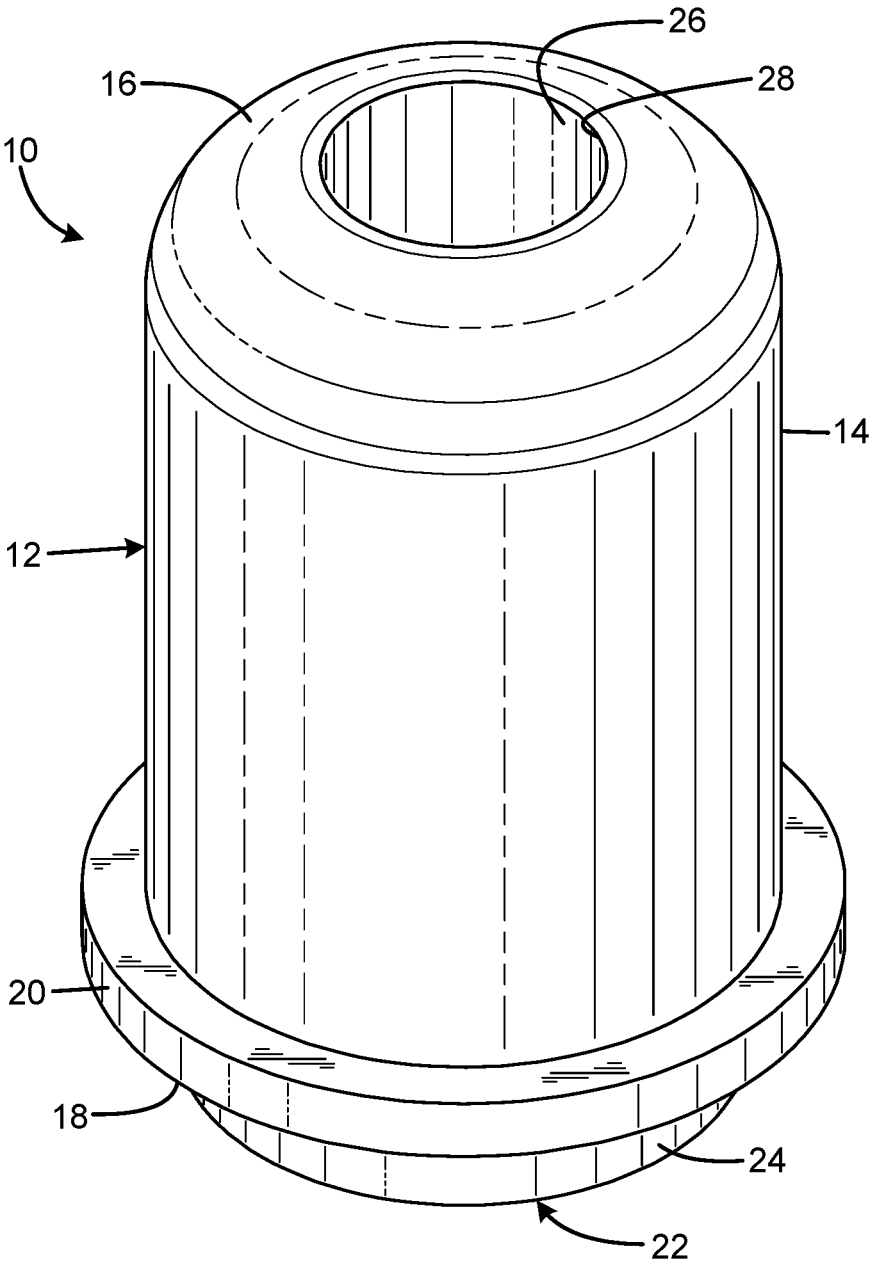
FIG. 1 is a front isometric view of the current embodiment of a primer adapter assembly constructed in accordance with the principles of the present invention.

An embodiment of the primer adapter assembly of the present invention is shown and generally designated by the reference numeral 10.

Figure 2:
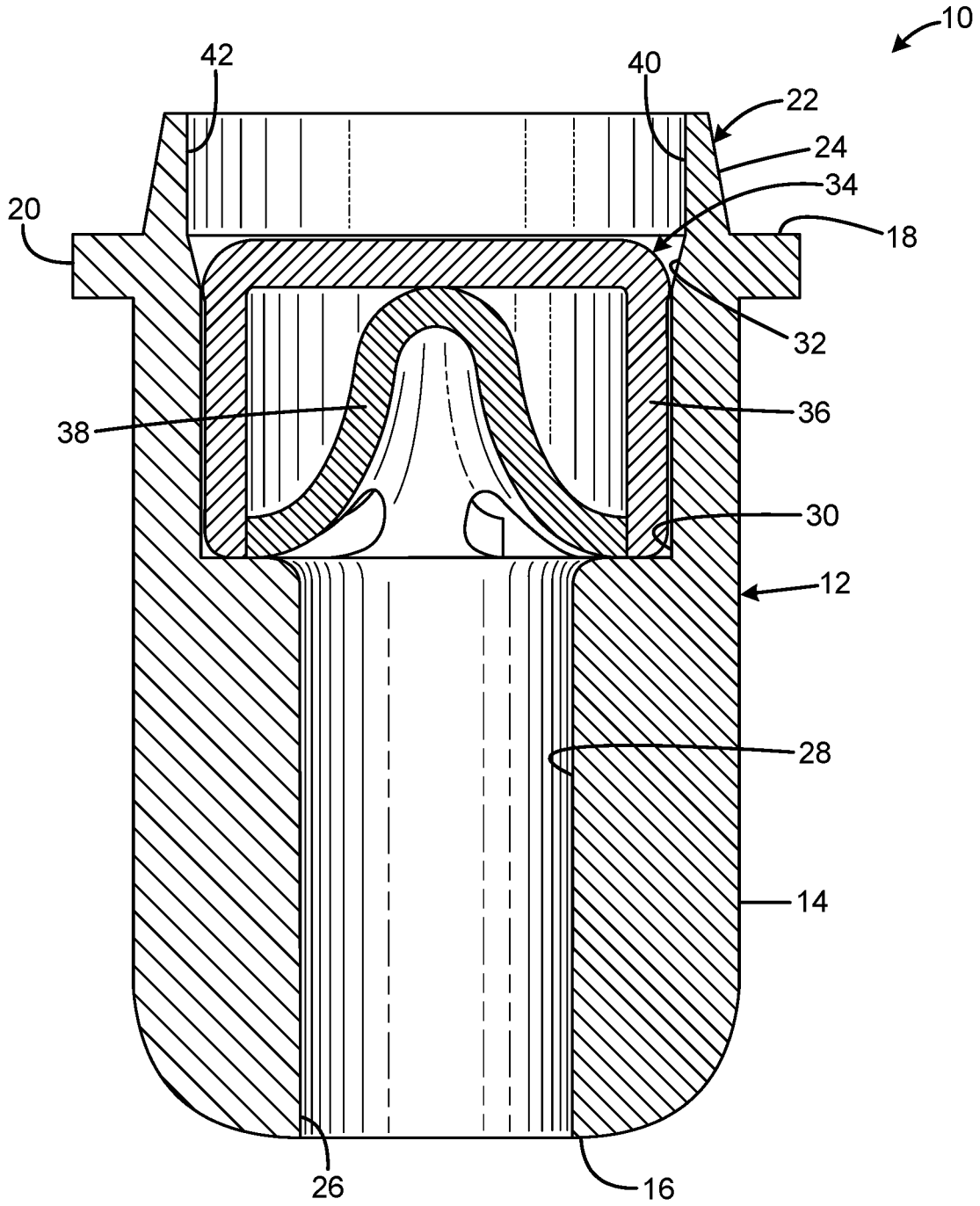
FIG. 2 is a side sectional view of the current embodiment of the primer adapter assembly of FIG. 1 in the uncrimped condition.

FIGS. 1 and 2 illustrate the improved primer adapter assembly 10 of the present invention. More particularly, the primer adapter assembly is shown prior to crimping and has a body 12 having a cylindrical exterior side wall 14, a front 16, and an aft surface 18. The body defines a central passage 26 including a forward portion 28, and a cylindrical aft portion 30. The body includes a laterally protruding flange 20 that defines the aft surface and a malleable retention skirt 22 that extends aft of the aft surface and defines an installation aperture 42. The skirt has a tapered exterior surface portion 24, a cylindrical interior surface portion 40 and a tapered cross-section. The central passage includes a flared portion 32 rearward of the cylindrical aft portion and forward of the skirt to facilitate insertion of a primer 34 into the cylindrical aft portion. The skirt encircles the central passage and is concentric with the central passage.

The cylindrical aft portion 30 of the central passage 26 is adapted to closely receive the primer 34 having a primer diameter. In the current embodiment, the primer is a conventional M42 small pistol primer having a primer cup 36 that receives a three-legged anvil 38 and a quantity of priming composition (not shown) between the three-legged anvil and the primer cup. However, the primer adapter assembly 10 can be adapted to fit any desired primer size. The forward portion 28 of the central passage has a forward diameter less than the primer diameter to limit forward movement of the primer within the central passage.

Figure 3:
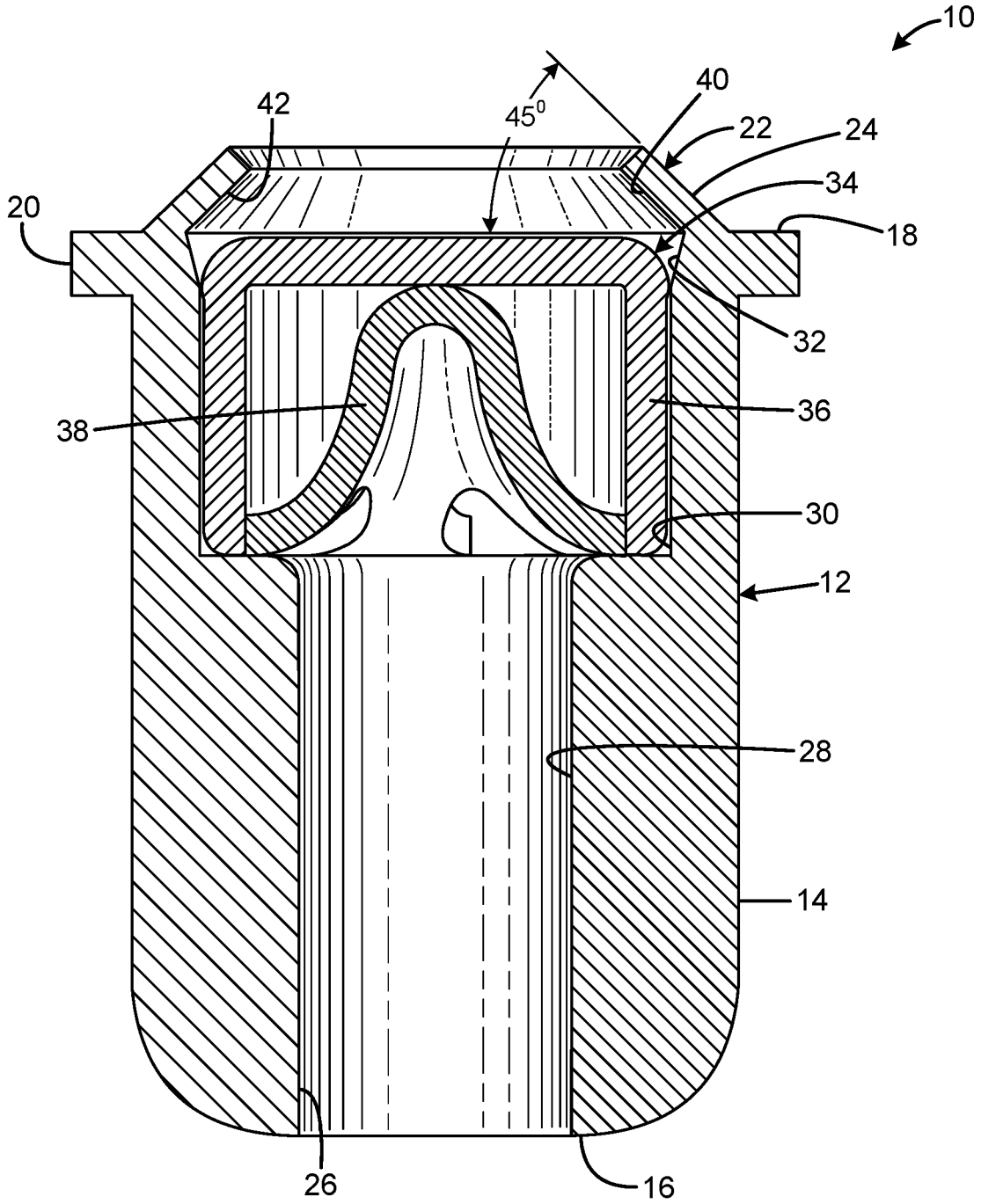
FIG. 3 is a side sectional view of the current embodiment of the primer adapter assembly of FIG. 1 in the first crimp condition.

FIG. 3 illustrates the improved primer adapter assembly 10 of the present invention. More particularly, the primer adapter assembly is shown having received a first crimp from a crimp starter station (not shown). The crimp starter station deforms the malleable skirt 22 to extend inwards such that the cylindrical interior surface portion 40 is bent at a 45° angle relative to the aft surface 18. As a result, the installation aperture 42 is narrowed to form an opening having a diameter less than the primer diameter.

Figure 4:
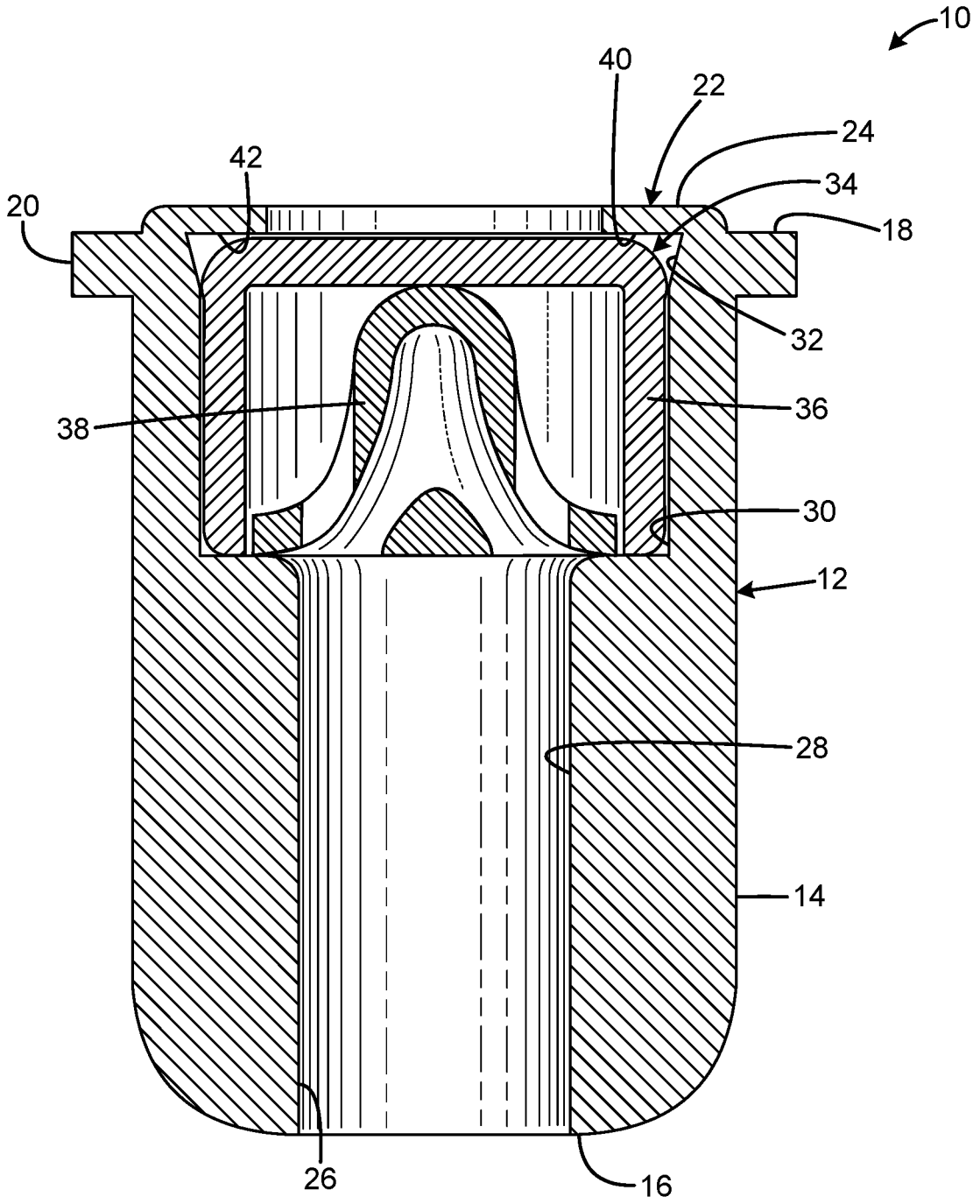
FIG. 4 is a side sectional view of the current embodiment of the primer adapter assembly of FIG. 1 in the fully crimped condition.

FIG. 4 illustrates the improved primer adapter assembly 10 of the present invention. More particularly, the primer adapter assembly is shown in the fully crimped and finished condition after having been crimped by a crimping station (not shown). The crimping station flattens the malleable skirt 22 such that the cylindrical interior surface portion 40 abuts the primer cup 36 and the cylindrical interior surface portion and the tapered exterior surface portion are both parallel to the aft surface 18. The installation aperture 42 is further narrowed to form an opening having a diameter less than the primer diameter such that the primer 34 in the cylindrical aft portion 30 of the central passage 26 is retained.

Figure 5:
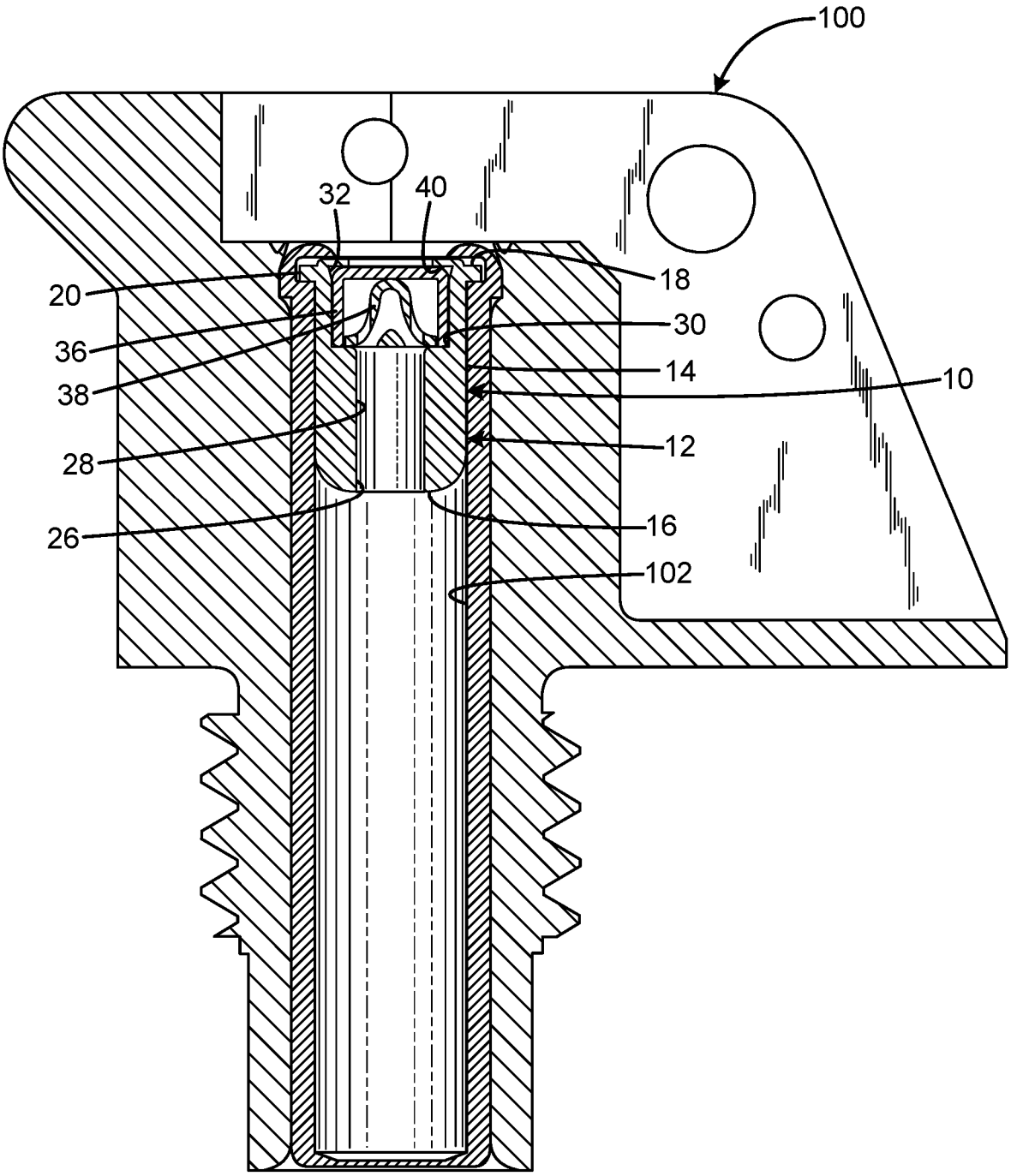
FIG. 5 is a side sectional view of the current embodiment of the primer adapter assembly of FIG. 1 in the fully crimped condition installed in a grenade fuze.

FIG. 5 illustrates the improved primer adapter assembly 10 of the present invention. More particularly, the primer adapter assembly is shown in the fully crimped and finished condition installed in a chamber 102 having a chamber diameter of a grenade fuze 100. The cylindrical exterior side wall 14 of the body 12 is adapted to be closely received in the chamber. The flange 20 has a diameter greater than the chamber diameter such that insertion of the primer adapter assembly into the chamber is limited. The primer diameter is greater than or equal to the chamber diameter such that a small interference fit up to 0.003 of an inch can exist to conform with Sporting Arms and Ammunition Manufacturers' Institute (SAAMI) primer cavity design standards.

When the fuze 100 functions, a striker within the fuze impacts the primer cup 36. The resulting indentation in the primer cup locally compresses the impact-sensitive priming composition between the indentation and the three-legged anvil 38, causing the priming composition to ignite. Because the primer cup is not perforated, the primer cup can maintain a relatively high-pressure gas seal. The crimped skirt 22 prevents the resulting gas pressure from blowing the primer 34 out of the body 12 and failing to ignite the grenade connected to the fuze (not shown). Instead, the crimp skirt retains the primer within the cylindrical aft portion 30 such that heat and gases emitted by the ignited priming composition travel through the forward portion 28 of the central passage 26 to ignite or detonate the charge (an explosive or chemical composition) within the grenade.

In the current embodiment, the primer adapter assembly 10 as a length of 0.380 inch, a diameter of 0.225 inch, and a forward radius of 0.055. The flange has a thickness of 0.023 inch and outer diameter of 0.270 inch. The maximum depth of the cylindrical aft portion is 0.165 inch. The forward portion of the central passage has a diameter of 0.102 inch. Prior to crimping, the installation aperture has a diameter of 0.185 inch. The flared portion is flared at an angle of 15°. The tapered exterior surface portion is tapered an angle of 10°. The malleable skirt has a height of 0.045 inch. The diameter of the cylindrical aft portion below the flared portion is 0.172 inch. The diameter of the skirt adjacent to the aft surface is 0.218 inch. The diameter of the aft most portion of the skirt is 0.202 inch.

To use the primer adapter assembly of the current invention with the M42 primer, the primer adapter assembly must receive the M42 primer and subsequently be crimped to retain the M42 primer. First, a loading block with apertures receives a primer adapter assembly within each aperture. In the current embodiment, the loading block has ten apertures and can be loaded manually or with tweezers or another suitable tool. The primer adapter assemblies are inserted so their skirts protrude upward from the loading block. Second, each primer adapter assembly receives an M42 primer, which can be loaded manually or with tweezers or another suitable tool. Alternatively, the primer adapter assembly can first be pressed downward onto an upside down M42 primer, and then subsequently inserted into an aperture in the loading block. Once all the primer adapter assemblies have been loaded with an M42 primer, each of the primers is checked to ensure no M42 primers are upside down. If any are, they are removed from their primer adapter assemblies, inverted, and replaced within their primer adapter assemblies.

The loading block is then fed into a primer pressing station. The loading block is advanced, and the primer pressing station cycled, until all the M42 primers are pressed into their primer adapter assemblies. Any improperly pressed M42 primers are removed with their primer adapter assemblies and scrapped prior to proceeding to the next step. The loading block is then fed into a crimp starter station. The loading block is advanced, and the crimp starter station cycled, until all the skirts have had their crimp started as shown in FIG. 3. Any malformed primer adapter assemblies are scrapped prior to proceeding to the next step.

The loading block is subsequently fed into a crimping station. The loading block is advanced, and the crimping station cycled, until all the skirts are fully crimped as shown in FIG. 4. Any improperly crimped primer adapter assemblies are scrapped prior to proceeding to the next step. The loading block is then inverted to empty the crimped primer adapter assemblies into a finished product bin, from which they can be taken to be assembled into a grenade fuze as a replacement for an M39A1 primer as shown in FIG. 5. Any crimped primer adapter assemblies that do not fall out when the loading block is inverted can be removed manually using a ram. If a ram is unsuccessful in removing a crimped primer adapter, the loading block is fed into a block clearing station. The loading block is advanced, and the block clearing station cycled, until all the crimped primer adapter assemblies are removed from the loading block. The empty loading block can then be reused.

While a current embodiment of a primer adapter assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A primer adapter for a fuse configured to be received in a device, the adapter comprising:

a body having a cylindrical exterior sidewall adapted to be closely received in a chamber defined by the fuse and having a chamber diameter;

the body defining a central passage including a cylindrical aft portion having an aft diameter adapted to closely receive a primer having a primer diameter greater than or equal to the aft diameter of the central passage;

the body having an aft surface;

a malleable skirt extending aft of the aft surface and defining an installation aperture, the skirt having an interior diameter greater than the aft diameter, the malleable skirt being operable to deform inward to form an opening having a diameter less than the primer diameter, such that a primer in the cylindrical aft portion of the central passage is retained;

the central passage including a flared portion between the cylindrical aft portion and the skirt to facilitate insertion of a primer into the cylindrical aft portion; and the flared portion having a tapered frusto-conical interior surface free of steps.

2. The primer adapter of claim 1 wherein the malleable skirt has a tapered cross-section.

3. The primer adapter of claim 1 wherein the malleable skirt encircles the central passage.

4. The primer adapter of claim 1 wherein the malleable skirt is concentric with the central passage.

5. The primer adapter of claim 1 wherein the body includes a flange defining the aft surface and having a diameter greater than the chamber diameter such that insertion of the primer adapter into the chamber is limited.

6. The primer adapter of claim 1 wherein the central passage includes a flared portion aft of the cylindrical aft portion and forward of the malleable skirt.

7. The primer adapter of claim 1 wherein the malleable skirt has a cylindrical interior surface portion.

8. The primer adapter of claim 1 wherein the malleable skirt has a tapered exterior surface portion.

9. The primer adapter of claim 1 wherein the central passage has a forward portion having a forward diameter less than the primer diameter.

10. The primer adapter of claim 1 further comprising:

the malleable skirt being connected to the aft surface and extending inward to form the opening having a diameter less than the primer diameter; and wherein the central passage has a forward portion having a forward diameter less than the primer diameter, and a length greater than the forward diameter.

11. The primer adapter of claim 10 wherein the malleable skirt has a tapered cross section.

12. The primer adapter of claim 10 wherein the malleable skirt encircles the central passage.

13. The primer adapter of claim 10 wherein the retention skirt is concentric with the passage.

14. The primer adapter of claim 10 wherein the body includes a flange defining the aft surface and having a diameter greater than the chamber diameter such that insertion of the adapter into the chamber is limited.

15. The primer adapter of claim 10 wherein the central passage includes a flared portion aft of the cylindrical aft portion and forward of the skirt.

16. The primer adapter of claim 10 wherein the cylindrical aft portion has an aft length, and wherein the forward portion has a length greater than the aft length.

17. The primer adapter of claim 10 wherein the forward portion is an open passage.

18. The primer adapter of claim 10 wherein the adapter body is a unitary element formed of a single inert material.

19. The primer adapter of claim 1 wherein the adapter body is a unitary element formed of a single inert material.

* * * * *